United States Patent [19]

Howanick

[11] Patent Number: 4,625,618

[45] Date of Patent: Dec. 2, 1986

[54] ELECTROMAGNETIC RAIL GUN SYSTEM AND CARTRIDGE THEREFOR

[75] Inventor: John J. Howanick, Fort Walton Beach, Fla.

[73] Assignee: GA Technologies Inc., San Diego, Calif.

[21] Appl. No.: 569,795

[22] Filed: Jan. 11, 1984

[51] Int. Cl.[4] ..... F41F 1/02

[52] U.S. Cl. ..... 89/8; 124/3; 310/12

[58] Field of Search ..... 89/7, 8; 102/472, 202.5, 102/441, 446, 470, 430; 124/3; 310/10–14; 318/135

[56] References Cited

U.S. PATENT DOCUMENTS

| | | | |
|---|---|---|---|
| 2,362,738 | 11/1944 | Yarbrough | 164/0.5 |
| 2,972,951 | 2/1961 | Stresau | 102/70.2 |
| 3,247,795 | 4/1966 | Abela | 102/38 |
| 3,431,816 | 3/1969 | Dale | 89/8 |
| 3,499,386 | 3/1970 | Stadler et al. | 102/86.5 |
| 3,844,216 | 10/1974 | Jakobs et al. | 102/46 |
| 3,855,900 | 12/1974 | Barr et al. | 89/159 |
| 4,130,060 | 12/1978 | Murray | 102/39 |
| 4,285,153 | 8/1981 | Crouch | 42/84 |
| 4,319,168 | 3/1982 | Kemeny | 318/135 |
| 4,433,607 | 2/1984 | Kemeny | 89/8 |

FOREIGN PATENT DOCUMENTS

| | | | |
|---|---|---|---|
| 2132322 | 7/1984 | United Kingdom | 89/8 |

*Primary Examiner*—David H. Brown
*Assistant Examiner*—John E. Griffiths
*Attorney, Agent, or Firm*—Fitch, Even, Tabin & Flannery

[57] ABSTRACT

An electromagnetic rail gun system includes an electromagnetic rail gun, a power supply, a cartridge and breech means for holding the cartridge. The gun includes a breech end and a muzzle end and a pair of substantially parallel rails defining a bore for receiving a projectile. The cartridge has releasably held projectile having a nose and a trailing end carrying an armature. The cartridge also includes a casing comprising a pair of electrically conductive casing segments spaced by insulation. The system further comprises interconnection means from the power supply connecting the breech end of the rails in parallel with the casing segments of a cartridge held in the breech means. The cartridge further includes shunt means interconnecting the casing segments for carrying current therebetween, and the armature is in electrically conductive relationship with the casing segments. The shunt means is able to be opened so that increased current thereupon flows through the armature to interact with the magnetic field generated by current flowing through the casing segments to provide a force to move the projectile into the rail gun bore.

18 Claims, 9 Drawing Figures

ELECTROMAGNETIC RAIL GUN SYSTEM AND CARTRIDGE THEREFOR

BACKGROUND OF THE INVENTION

The present invention relates to rail gun systems and cartridges therefor and, more particularly, to a cartridge having a projectile for being accelerated by an electromagnetic rail gun system.

An electromagnetic rail gun is, in essence, a linear direct current motor. A prior art rail gun includes a pair of spaced copper rails, the breech ends of which are connected with a source of direct current. A projectile carries at its trailing end an armature in the form of a conductive sliding block. As current flows from the breech end of the first rail, through the block, and back toward the breech end of the second rail, the magnetic field provided by current flowing through the rails interacts with the current flowing through the sliding block to produce a force (the Lorentz force) which accelerates the projectile toward the muzzle end of the rails.

One significant advantage that electromagnetic rail guns have over more common guns relying on the detonation of an explosive charge to accelerate a projectile, is greatly increased muzzle velocity. The latter type gun is limited by the speed at which gases resulting from the detonation are able to expand. This, in a practical gun, results in a maximum muzzle velocity of about two kilometers per second. Theoretically, and without taking into account the strength of the materials of the rails and projectile, the limit of the muzzle velocity of a rail gun in vacuum is the speed of propagation of a magnetic field (approximately the speed of light). Muzzle velocities of small bore rail guns have exceeded 10 kilometers per second. Particularly in military applications, increased muzzle velocity is of paramount importance because it affords the weapon greater range and lessens the time a target has to undertake evasive action.

Prior art rail guns are typically more on the order of laboratory curiosities than practical weapons. They are limited to a single shot capability and often require replacement of the rails after each firing due to arc damage when the projectile is accelerated from rest. More specifically, with the rails deenergized, the projectile with its sliding block armature is manually loaded into the breech end of the gun. A crowbar switch is then closed to cause energization of the rails by a primary power source, such as a large capacitor bank. Upon closing of the switch, very high current (up to ½ to ¾ mega amperes) flows through the breech portion and the rails and the projectile armature.

Because the projectile starts from a static condition and is accelerated generally throughout its travel in the rail gun, the projectile has a high dwell time in the breech end of the rail gun, typically resulting in arc damage such as pitting, erosion or melting in that portion of the rails. Additionally, acceleration of the projectile from a rest condition requires the use of a longer barrel for the projectile to achieve a desired velocity. The use of a longer barrel is undesirable because it necessitates a longer current path through the rails, causing greater heating losses and the storage of greater energy in the magnetic field between the rails, thereby reducing the efficiency of the rail gun. Moreover, a longer rail gun takes up more space, uses more material and has greater weight.

Previous rail guns have accelerated ballistically unstable projectiles, typically encased in sabots. The sliding block armature of the projectile has shortcomings in that it can move out of mutual contact with both rails, hence increasing the resistance to current flow, and exhibits a large drag force on the rails when in contact therewith. Furthermore, the continued presence of the relatively heavy armature at the trailing end of the projectile does not permit a proper weight distribution as required for a true ballistic projectile. It is simply too tail heavy for proper stable flight.

One proposed rail gun used the expansion of light gas caused by initiation of an electrical arc through it to accelerate the projectile initially, with the rail gun further accelerating it. This rail gun also was limited to single shot capability and, besides requiring an external source of electrical power, required an external source of the light gas. For a further description of the structure and operation of this rail gun, reference may be made to the U.S. Pat. No. 3,431,816.

In summary, such prior art rail guns, and the projectiles for use therewith, are not particularly attractive to the military as an alternative to the much more common propellant discharge guns. The prior art rail guns typically have only single shot capability and must be, at least partially, disassembled before insertion of a second projectile. Such rail guns also may require external supplies of propellant, such as a light gas, for initially moving the projectile. In addition, previous electromagnetically accelerated projectiles were non-ballistic laboratory devices, many of which were fired in a vacuum.

SUMMARY OF THE INVENTION

Among the several aspects of the present invention may be noted the provision of an improved electromagnetic rail gun system and cartridge therefor; the provision of such cartridge which permits acceleration of a projectile from rest due, at least in part, to interaction of a magnetic field and current flow without damage to the rails of the rail gun; the provision of such cartridge which confines damage due to arcing to components of the cartridge; the provision of such cartridge which increases the efficiency of the rail gun by preaccelerating the projectile prior to its entry into the rail gun; the provision of such rail gun system and cartridge which is responsive to current flow in a circuit reaching a predetermined level to accelerate the projectile; the provision of such cartridge which acts as a switch to start conduction between the rails, avoiding the use of other switches and timing circuits therefor; the provision of such cartridge which is suitable for use with a rapid fire feed mechanism; the provision of such cartridge which maintains an appropriate electrical path between the rails to accelerate the projectile while permitting the proper weight distribution of a ballistic projectile; and the provision of such rail gun system and cartridge which is reliable in use and is simple and economical to manufacture. Other aspects and features will be in part apparent and in part pointed out hereinafter in the specification and attendant claims.

Briefly, the electromagnetic rail gun system of the present invention includes an electromagnetic rail gun having a breech end and a muzzle end and a pair of substantially parallel rails defining a bore for receiving a projectile. The sytsem further comprises a power supply for providing substantially constant voltage direct current. A cartridge includes a releasably held projectile having a nose and a trailing end carrying an armature. The cartridge further includes a casing comprising a pair of electrically conductive casing segments by insulating means. The system also includes breech means for holding the cartridge with the projectile aligned with the bore, and interconnection means from the power supply connecting the breech end of the rails in parallel with the casing segments of a cartridge held in the breech means. The cartridge also includes shunt means interconnecting the casing segments for carrying current therebetween and the armature is in electrically conductive relationship with the casing segments. The shunt means is changeable from a closed current carrying condition to an open condition in which current cannot pass through the shunt means.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
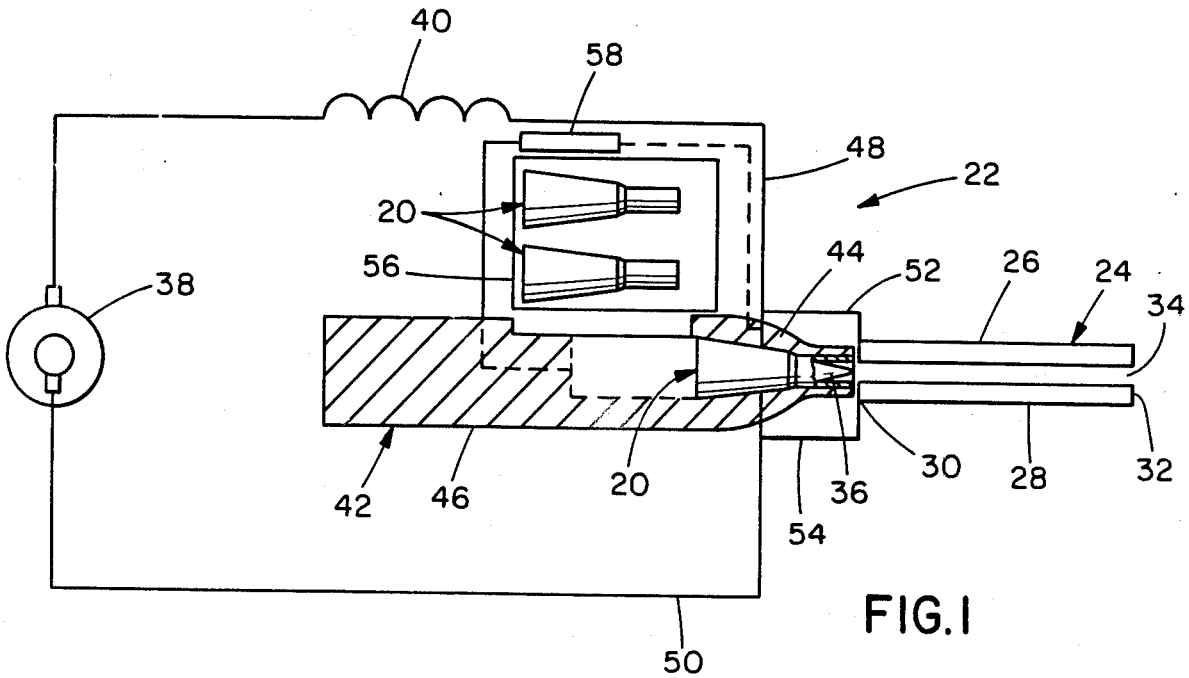
FIG. 1 is a diagrammatic illustration of one form of an electromagnetic rail gun system for use with the cartridge of the present invention.

Referring now to the drawings, a cartridge for use with an electromagnetic rail gun system 22 is indicated generally by reference character 20. The rail gun system 22 includes a rail gun 24 comprising a pair of electrically conductive rails 26, 28 extending from a breech end 30 to a muzzle end 32 and defining a bore 34 for receiving a projectile 36 carried by the cartridge 20. Although not shown, it will be appreciated that a barrel for the rail gun 24 also includes insulation and other structural members functioning to offer structural integrity to maintain the rails 26, 28 isolated from one another in their spaced positions and to define the bore 34.

The rail gun system 22 also includes a power supply for providing substantially constant voltage direct current, such as a high voltage homopolar generator 38 serially connected with an energy storage inductor 40. Also included in the gun system 22 is breech means 42 for holding a cartridge 20 so that its projectile 36 is in alignment with the bore 34. The rails 26, 28 are connected electrically in parallel with the breech means 42 and in series with the serial combination of the generator 38 and inductor 40 by interconnection means comprising a plurality of low inductance, low impedance transmission lines. More specifically, the breech means includes a bolt 44 and a breech body 46 electrically isolated from one another. The interconnection means includes a first transmission line 48 connecting the inductor 40 and the bolt 44, a second transmission line 50 joining the homopolar generator 38 and the breech body 46, with the lines 48, 50 having extensions 52, 54 connected to the breech ends of the rails 26, 28, respectively.

Also included in the gun system 22 is an automatic feed means 56 for holding a plurality of the cartridges 20 and inserting them serially into the breech means 42 which includes ejection means for ejecting a spent cartridge casing. Such breech means, ejection means and feed means are of the general type used with conventional rapid fire propellant discharge guns and thus are of the type well known to those skilled in the weaponry art. Finally, the system 22 includes a current sensor 58 responsive to a predetermined current level being reached to control firing of a cartridge 20 retained in the breech means 42, as will be discussed more fully hereinafter. The current sensor 58 is set to fire the cartridge only after the inductor 40 has time to be substantially recharged after a previous cartridge firing.

Figure 3:
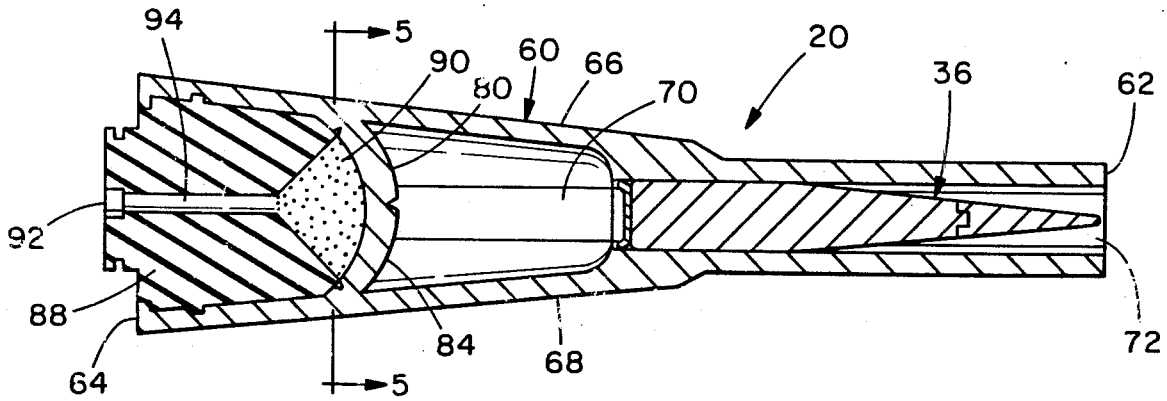
FIG. 3 is a longitudinal cross-sectional view of a cartridge useful in the system of FIG. 1.
Figure 4:
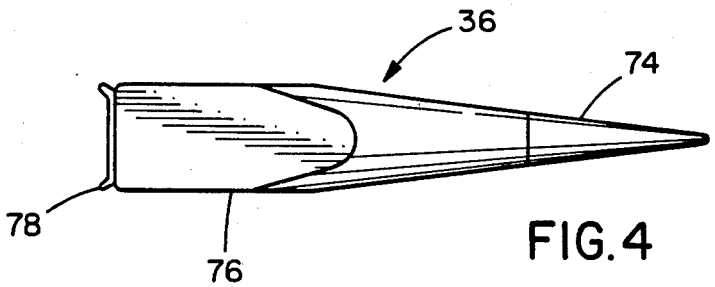
FIG. 4 is a side elevational view of a projectile of the cartridge of FIG. 3.
Figure 5:
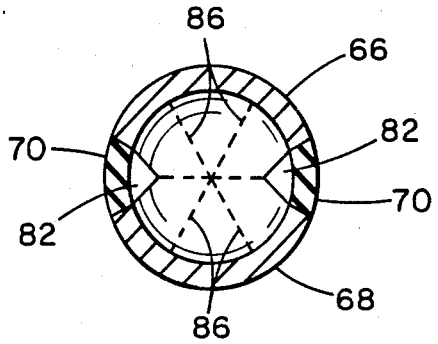
FIG. 5 is a sectional view of the cartridge shown in FIG. 3 taken generally along line 5—5 of FIG. 3 and showing a shunt in its as-formed closed condition.

Referring to FIGS. 3–5, the cartridge 20 comprises an elongated casing 60 having a front end 62 and a rear end 64. The casing 60 is formed by a pair of electrically conductive casing segments 66, 68 spaced from one another by insulating means in the form of spacer portions 70 (see FIG. 5). A projectile 36 (best shown in FIG. 4) is releasably held by the casing 60 in a retention chamber 72, as by crimping the casing front end about the projectile, adjacent its front end 62. The projectile 36 includes a body having a generally conical nose 74, a trailing end 76, preferably of either generally circular or square cross section, and an armature 78 carried by the trailing end 76 and in electrically conductive relationship with the casing segments 66, 68 for carrying current therebetween. As shown, the projectile 36 is of the non-saboted, non-spinning, drag stabilized type, and its body is formed of electrically non-conductive material or an electrically conductive material with a non-conductive coating. The armature 78 is in the form of a fuse which vaporizes or ablates upon the passage of high current therethrough to form a plasma arc for continuing to conduct current not only as the projectile is accelerated from its rest position in the casing, but also as the projectile passes through and is accelerated by the rail gun 24. The term "fuse" as used herein is to be accorded its broad meaning which includes: a piece of fusible metal which vaporizes upon the passage of large current through it, without regard to whether or not such vaporization interrupts the passage of current.

The cartridge 20 also includes shunt means in the form of a dome-shaped shunt 80 interconnecting casing segments 66, 68 for carrying current therebetween. The shunt 80 preferably has significantly greater cross-sectional area than does the armature 78 so that when both are disposed in parallel, much greater current passes through the shunt 80. As shown in FIG. 5, windows 82 are formed in the shunt adjacent insulative spacer portions 70 of the casing and the shunt has weakened areas to enable the shunt to deform in a predetermined manner upon being acted upon by a predetermined force. More particularly, the concave surface 84 of the shunt is provided with score lines 86 or grooves to define the weakened areas with the lines intersecting at the center of the shunt so that application of a sufficiently large force directed at the center of the concave side of the shunt causes the shunt to burst and fragment into a plurality of flaps 87 deformed to lie adjacent the respective casing segments 66, 68 (see FIG. 6) thereby open-circuiting the shunt to cause passage of increased current through the armature 78, resulting in its ablation. The convex surface of the shunt 80 may also be provided with grooves to aid in separation of the flaps 87 upon firing of the cartridge 20.

Figure 6:
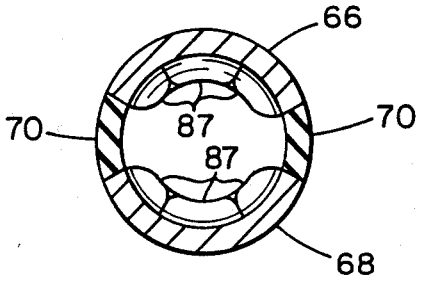
FIG. 6, similar to FIG. 5, depicts the shunt open-circuited due to firing of the cartridge.

Further included in the cartridge 20 are detonatable explosive means for opening the shunt 80 and an electrically insulative plug 88 held by the casing 60 adjacent its rear end 64 with the explosive means disposed between the shunt and the plug. The explosive means comprises a shaped charge 90 for directing the force generated by its detonation against the weakened areas of the shunt so that it will rupture as described hereinbefore. Preferably, the charge 90 is of the type including a portion of relatively slow explosive and a portion of relatively fast explosive. Such shaped charges are well known to those of skill in the weaponry art. Suffice to say that the shaped charge in combination with the dome-shaped shunt functions to localize the impact generated by detonation on the center of the shunt to insure its opening as shown in FIG. 6. The cartridge also includes an electrically operated primer 92 carried at the cartridge rear end, and the plug 88 has a flash tube 94 extending between the primer 92 and the shaped charge 90. The current sensor 58 is connected to be responsive to a predetermined level of current flow through the shunt 80 being achieved for firing the primer 92 and thereupon generating a flame front which is propagated to the shaped charge 90 by the flash tube 94 for effecting detonation of the charge.

Figure 2:
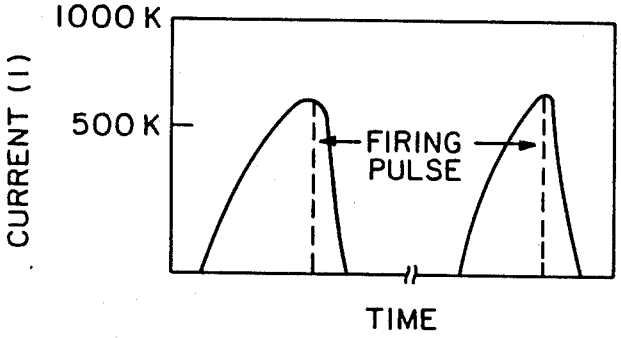
FIG. 2 is a graph of current magnitude measured at a predetermined location in the gun system with respect to time, depicting application of firing pulses to the cartridges of FIG. 1.

A plot of time versus current flow through the shunt 80 of a cartridge 20 loaded into the breech means 42 is depicted in FIG. 2.

Of course, with the projectile driven out of the casing and into the rail gun 24 after opening of the shunt 80, the bolt 44 and the breech body 46 are open-circuited. Once the projectile enters the rail gun 24, it is accelerated by Lorentz forces produced by the flow of current through the vaporized armature 78 sustained by the inductor 40. The energy for such acceleration comes in large measure from that stored in the inductor 40, and the current in the inductor 40 drops off. At the same time the load on the homopolar generator 38 during by acceleration of the projectile by the rail gun 24 causes some reduction in its normal operating rotor speed of about 6000 rpm. Upon departure of the projectile from the rail gun, a plasma arc following the projectile continues to conduct current until its path becomes so large that the voltage is no longer able to sustain the arc thus causing the arc to be extinguished. At that point, the current in the inductor 40 has dropped substantially to zero, although under some circumstances the next cartridge may be inserted before the current reaches zero. Alternatively, the muzzle end of the rail gun could be connected to ground through a spark gap to dissipate energy stored in the magnetic field existing between rails 26, 28 upon exit of the projectile.

Upon loading of the next cartridge 20 in the breech 42, current starts to flow through the shunt 80. The change in current flow is not instantaneous due to the presence of the energy storage inductor 40. The current sensor 58 is set to initiate firing of the cartridge upon the current flow reaching sufficient magnitude that a projectile can be appropriately accelerated by the rail gun 24 when the next projectile is driven from the casing 60 into the rail gun. As shown in FIG. 2, that current level for a homopolar generator may be in the range of one-half to three-quarters megamperes. Thus one function of the shunt 80 is to permit recharging of the inductor 40 before the firing of the cartridge.

Operation of the cartridge and the rail gun system for use therewith are as follows: After the starting of the homopolar generator which may be driven, for example, by a fast start turbine, and upon its reaching proper operation speed, insertion of the cartridge in the breech means results in current flow through the energy storage coil 40, the transmission line 48, a casing segment 66, the parallel combination of the shunt 80 and a projectile armature 78, a casing segment 68 and back to the power supply through the transmission line 50. The current flow through the armature is not sufficient to vaporize the armature or apply such force on the projectile because the majority of the flow is through the shunt 80. It will be appreciated that the casing segments receive the current flow at locations between the armature and the shunt.

When the current sensor 58 detects that the current flow has achieved the predetermined level, it provides a signal causing firing of the primer 92 of a cartridge 20 in the breech means 42. This effects detonation of the charge 90 resulting in opening of the shunt 80. All the current flow must then be through the armature 78, and the heavy current flow causes it to vaporize to form a plasma arc. The current flow in the casing segments establishes a magnetic field which is interactive with the current flow though the plasma arc to produce a force which cooperates with the force caused by detonation of the charge to propel the projectile out of the casing 60 and into the rail gun bore 34. When the plasma arc following the projectile makes mutual contact with rails 26, 28, current flows through the transmission line extension 52, the rail 26, the plasma arc, the rail 28, and back to the power supply through the extension 54 and the transmission line 50. The projectile is thereby accelerated throughout its travel through the rail gun 24. The feed means 56 is adapted to load another cartridge 20 into the breech means 42 after the ejection means unloads the spent casing and current flow in the rails has substantially if not entirely ceased after departure of the projectile. Firing of the rail gun system 22 recurs upon the current sensor 58 detecting the necessary current flow. The gun system 22 may have a firing rate of more than 1,000 rounds per minute.

In sharp contrast to previous rail gun systems wherein acceleration from a rest condition was initiated in the rail gun barrel itself, resulting in damage thereto, in the present invention initial projectile propulsion takes place while the projectile is held by the cartridge casing. The cartridge casing segments 66, 68 are the components suffering arc pitting and erosion due to acceleration of the projectile from rest. However, damage to the inside of the casing segments is inconsequential because they are only used once, and a new casing is provided after each firing. The casing segments 66, 68 can be considered to comprise a disposable "mini" rail gun for starting the projectile 36 from a static condition (and enduring the resultant damage) and transferring the projectile to the main rail gun 24 in a dynamic condition so that the latter rail gun can further accelerate the projectile. It will be appreciated that while the gases generated by detonation of the charge 90 may in a minor way contribute to movement of the projectile 36 into the rail gun 24, the primary motive force results from the interaction of the magnetic field generated by current flowing through the casing segments, with the current flowing through the armature 78.

Figure 7:
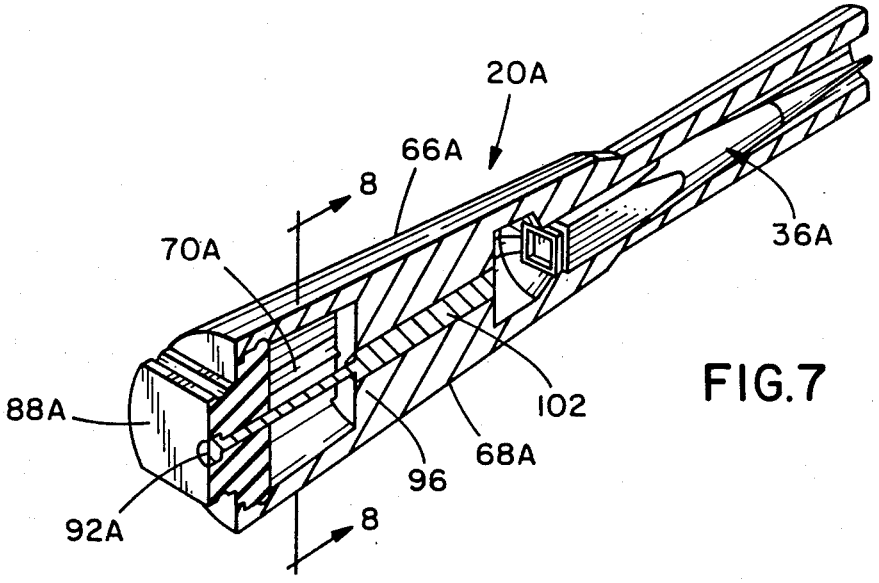
FIG. 7 is a perspective view with certain components removed of another cartridge useful in the system of FIG. 1.
Figure 8:
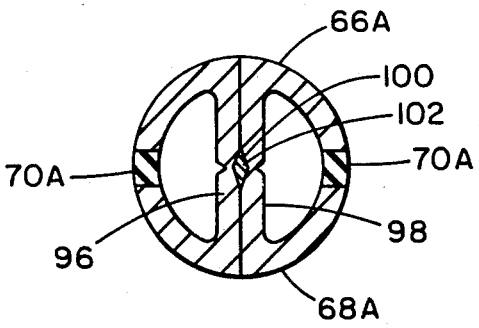
FIG. 8 is a sectional view of the cartridge of FIG. 7 taken generally along line 8—8 of FIG. 7 and showing a shunt in its as-formed closed condition.
Figure 9:
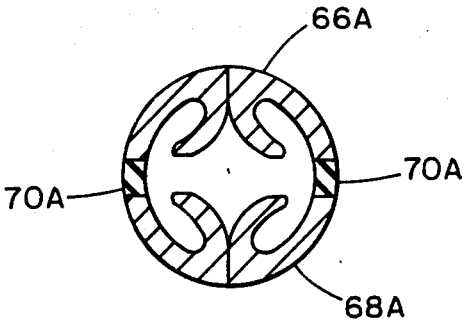
FIG. 9, similar to FIG. 8, illustrates the cartridge upon firing resulting in opening of the shunt.

Referring now to FIGS. 7–9, an alternative cartridge invention is indicated generally by reference character 20A. Components of the cartridge 20A corresponding to those of the previously described cartridge 20 are indicated by the reference numeral applied to the component of the cartridge 20 with addition of the suffix "A". The structure of cartridge 20A is quite similar to that of the cartridge 20 with the exception that the shunt means of the cartridge 20A includes a pair of conductors 96, 98 each interconnecting the casing segments 66A, 68A and together defining an aperture 100 for receiving the detonatable explosive means which, as shown, comprises a detonator cord 102. Each of the conductors 96, 98 includes a structurally weakened portion, the weakened portions defining the aperture 100. Firing of the primer 92A causes detonation of the cord 102, rupturing the conductors 96, 98 (as shown in FIG. 9) to open circuit the shunt means. Operation in the system of the cartridge 20A is substantially identical to that described with reference to cartridge 20.

It is within the scope of this invention that the material and cross-sectional area of the shunt means is closely matched with the predetermined current flow through the shunt. In this way, the shunt melts upon the current flow reaching that predetermined level, transferring full current flow through the armature and resulting in its vaporization and movement of the projectile into the rail gun. Although extremely close manufacturing tolerances would be required, the need for the current sensor, the primer, and the detonatable explosive charge would be thus obviated.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limited sense.

What is claimed is:

1. An electromagnetic rail gun system comprising:

an electromagnetic rail gun having a breech end and a muzzle end and a pair of substantially parallel rails partly defining a bore for receiving a projectile;

a power supply for providing substantially constant voltage direct current;

a cartridge including a releasably held projectile having a nose and a trailing end carrying an armature, said cartridge further including a casing comprising a pair of electrically conductive casing segments spaced from one another by insulating means;

breech means for holding said cartridge with said projectile aligned with said bore; and interconnection means from said power supply connecting the breech end of said rails in parallel with the casing segments of said cartridge held in said breech means, said cartridge further comprising shunt means interconnecting said casing segments for carrying current therebetween, said armature being in electrically conductive relationship with said casing segments, and said shunt means being changeable from a closed current carrying condition to an open condition in which current cannot pass through said shunt means, whereby opening of said shunt means results in increased flow of current through said armature which current interacts with the magnetic field generated by current flowing through said casing segments to provide a force to move said projectile into said rail gun bore.

2. An electromagnetic rail gun system as set forth in claim 1 further comprising an energy storage inductor series connected with said power supply and the parallel combination of said rails and said casing segments.

3. An electromagnetic rail gun system as set forth in claim 1 further comprising feed means for holding a plurality of said cartridges and inserting them serially into said breech means.

4. An electromagnetic rail gun system as set forth in claim 1 wherein said armature is a fuse which vaporizes to form a plasma arc upon opening of said shunt means.

5. An electromagnetic rail gun system as set forth in claim 1 wherein said cartridge further includes detonatable explosive means disposed within said casing for opening said shunt means.

6. An electromagnetic rail gun system as set forth in claim 5 wherein said cartridge further comprises a primer, the firing of which results in detonation of said explosive means.

7. An electromagnetic rail gun system as set forth in claim 6 further comprising a sensor responsive to the current flow through said shunt means achieving a predetermined level to fire said primer.

8. An electromagnetic rail gun system comprising:

a main electromagnetic rail gun having a breech end and a muzzle end and a pair of substantially parallel electrically conductive rails partly defining a bore for receiving a moving projectile at said breech end;

a disposable mini rail gun held in alignment with said main rail gun for accelerating a projectile from a static condition and transferring it to said main rail gun, said mini rail gun comprising a pair of electrically conductive segments separated by insulation;

a projectile having a nose end and a trailing end carrying an armature, said projectile being releasably held by said mini rail gun with said armature and said segments forming an electrically conductive path;

a power supply for providing a substantially constant voltage direct current; and interconnection means from said power supply connecting the breech end of said rails in parallel with said segments.

9. A rail gun system as set forth in claim 8 further comprising a breech means for holding a cartridge, said cartridge comprising said mini rail gun and said projectile and said cartridge further including shunt means interconnecting said segments, for carrying current therebetween, in parallel with said armature.

10. A rail gun system as set forth in claim 9 further comprising:

an energy storage inductor in series with said power supply and said interconnection means;

means for opening said shunt means so that all current flow between said segments is through said armature; and sensor means for operating the opening means when the current flow through said inductor reaches a predetermined level.

11. A cartridge for an electromagnetic rail gun system including an electromagnetic rail gun having a breech end, a muzzle end and a pair of rails extending between said end and partly defining a bore for said rail gun, the breech ends of said rails being connected with a generally constant voltage direct current power supply, said cartridge comprising:

a casing having a front end and a rear end and a pair of electrically conductive casing segments spaced from one another by insulating means to define a cavity;

a projectile releasably held by said casing in said cavity adjacent said front end, said projectile having a nose, a trailing end and an armature carried by said trailing end, said armature being in electrically conductive relationship with said casing segments; and shunt means interconnecting said segments for carrying current therebetween, said shunt means being changeable from a closed, current carrying condition to an open condition in which current cannot pass through said shunt means whereby, when said cartridge is held in alignment with the bore of said rail gun and said casing segments electrically connected in parallel with said rails, opening of said shunt means results in increased flow of current through said armature which interacts with the magnetic field established by current flowing through said casing segments to provide a force to move said projectile into said rail gun.

12. A cartridge as set forth in claim 11 further comprising detonatable explosive means for opening said casing shunt means.

13. A cartridge as set forth in claim 12 further comprising electrically insulative plug means held adjacent said casing rear end with said shunt means and said explosive means being disposed between said projectile and said plug means.

14. A cartridge as set forth in claim 13 further comprising a primer disposed at said cartridge rear end for initiating detonation of said explosive means.

15. A cartridge as set forth in claim 14 wherein said plug means includes a flash tube for propagating the flame front generated by the firing of said primer to said explosive means to cause detonation thereof.

16. A cartridge as set forth in claim 12 wherein said shunt means has weakened areas to aid in opening of said shunt means by deformation.

17. A cartridge as set forth in claim 16 wherein said explosive means comprises a shaped charge for directing the force generated by detonation of said explosive means against said weakened areas so that said shunt means will deform in a predetermined manner.

18. A cartridge as set forth in claim 16 wherein said shunt means is dome-shaped with said explosive means facing the concave surface of said shunt means, said concave surface having score lines to define said weakened areas with said score lines intersecting at the center of said shunt means whereby detonation of said explosive means causes said shunt means to break into a plurality of flaps deformed to lie adjacent said respective casing segments.

* * * * *